US008680418B2

(12) United States Patent
Nakajima et al.

(10) Patent No.: US 8,680,418 B2
(45) Date of Patent: Mar. 25, 2014

(54) ROTATION OPERATING DEVICE

(75) Inventors: Hirokatsu Nakajima, Yokkaichi (JP); Satoru Chaen, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 54 days.

(21) Appl. No.: 13/521,561

(22) PCT Filed: Nov. 16, 2010

(86) PCT No.: PCT/JP2010/006712

§ 371 (c)(1), (2), (4) Date: Jul. 11, 2012

(87) PCT Pub. No.: WO2011/104793

PCT Pub. Date: Sep. 1, 2011

(65) Prior Publication Data

US 2013/0032456 A1 Feb. 7, 2013

(30) Foreign Application Priority Data

Feb. 24, 2010 (JP) ..... 2010-038577

(51) Int. Cl.
*H01H 13/62* (2006.01)

(52) U.S. Cl.
USPC ..... 200/565

(58) Field of Classification Search
USPC ..... 200/564–565, 336, 61.54, 61.55, 4, 5 R, 200/14, 17 R, 18, 1 B, 339, 61.56, 61.57, 200/553, 6 A, 520
See application file for complete search history.

(56) References Cited

U.S. PATENT DOCUMENTS

| | | | | |
|---|---|---|---|---|
| 5,294,121 | A * | 3/1994 | Chiang | 273/148 B |
| 5,514,843 | A * | 5/1996 | Wilfong et al. | 200/5 R |
| 7,053,320 | B2 | 5/2006 | Kodo et al. | |
| 2003/0094354 | A1 * | 5/2003 | Badarneh | 200/18 |
| 2006/0132347 | A1 | 6/2006 | Hanahara et al. | |
| 2007/0272524 | A1 | 11/2007 | Girke et al. | |

FOREIGN PATENT DOCUMENTS

| | | |
|---|---|---|
| JP | 2002-157062 | 5/2002 |
| JP | 2005-32450 | 2/2005 |
| JP | 2005-174806 | 6/2005 |
| JP | 2006-164871 | 6/2006 |
| JP | 2006-179394 | 7/2006 |
| JP | 2007-506233 | 3/2007 |

* cited by examiner

*Primary Examiner* — Edwin A. Leon
(74) *Attorney, Agent, or Firm* — Greenblum & Bernstein P.L.C.

(57) ABSTRACT

A rotation operating device is provided on a circuit board for detecting a rotation operation and imparting feedback for the rotation operation to a user while avoiding a significant increase in necessary surface area of the circuit board. The rotation operating device includes a rotatable rotation operating member; a rotation detection switch provided on the circuit board and detecting rotation of the rotation operating member; and an operational feedback imparting mechanism for imparting operational feedback to the user. The rotation operating member includes an inner circumferential surface surrounding an interior space, and both the rotation detection switch and the operational feedback imparting mechanism are positioned within this interior space. The rotation operating member includes a switch operator operating the rotation detection switch, and an operational feedback generator formed on an inner circumferential surface of the rotation operating member at a position away from the switch operator.

7 Claims, 7 Drawing Sheets

ROTATION OPERATING DEVICE

FIELD OF THE INVENTION

The present invention relates to a rotation operating device provided to a panel in a vehicle cabin interior or the like.

BACKGROUND OF THE INVENTION

In general, a rotation operating device provided to a vehicle cabin interior of an automobile, for example, includes a rotation operating member receiving a rotation operation while being held in fingers or the like and a detection device outputting a detection signal corresponding to a direction and amount of the rotation operation. A rotary encoder can be employed as the detection device, however, such a rotary encoder is typically expensive, and therefore performing detection of the rotation operation with an inexpensive switch in place thereof has been considered.

As a rotation operating device employing such a switch, the device shown in FIG. 9 is conventionally known (FIG. 6 of Patent Literature 1). This device includes a dial (not shown in the drawing) receiving a rotation operation, an operating body 2, and a rotation detection switch 3.

The operating body 2 is connected to the dial so as to integrally and coaxially rotate with the dial. The outer circumferential surface of the operating body 2 has a shape in which the rotation detection switch 3 is intermittently operated in conjunction with rotation of the operating body 2. Specifically, the outer circumferential surface includes a plurality of projections 5 projecting outwardly in a radial direction and, in addition, the projections 5 are intermittently aligned in a circumferential direction.

The rotation detection switch 3 is mounted on a circuit board not shown in the drawing and includes a sensor 4 and a plurality of terminals 6A, 6B, and 6C. The terminals 6A-6C are connected to the circuit board. The sensor 4 is attached to a main body of the rotation detection switch 3 so as to be swingable around an axis 8 parallel to an axis at a center of rotation of the operating body 2; is intermittently in contact with the projections 5 in association with the rotation of the operating body 2; and, in addition, is positioned so as to rotate codirectionally with a displacement direction (rotation direction) of the projections 5 accompanying the contact therewith.

The rotation detection switch 3 outputs a signal corresponding to the rotational direction of the sensor 4. Specifically, the dial and the operating body 2 are rotatingly operated in a clockwise direction, as shown in FIG. 9(*b*). In association therewith, the sensor 4 intermittently dips in a direction (a left direction in the drawing) corresponding to the rotation direction, and each time an electrical signal is output from the terminals 6A and 6B to the circuit board. In an opposite manner, the dial and the operation body 2 are rotatingly operated in a counter-clockwise direction, as shown in FIG. 9(*c*). In association therewith, the sensor 4 intermittently dips in a direction (a right direction in the drawing) corresponding to the rotation direction, and each time an electrical signal is output from the terminals 6A and 6C to the circuit board.

Accordingly, a determination is made of the terminals outputting an electrical signal from the rotation detection switch 3 and, from the number of outputs therefrom, a rotational direction and rotation amount of the dial are obtained.

With the rotation operating device described above, the rotation detection switch 3 must be provided in the vicinity of the operating body 2, increasing the necessary surface area of the circuit board by an amount of space required for such placement. Moreover, in order to give a user feedback for a rotation operation in conjunction with rotation detection of the dial, a mechanism (for example, a clicking mechanism) which imparts operational feedback must be provided separately from the rotation detection switch, requiring further space for such placement.

RELATED ART

Patent Literature

Patent Literature 1: Japanese Patent Laid-open Publication No. 2005-32450

SUMMARY OF THE INVENTION

An object of the present invention is a rotation operating device provided on a circuit board and being capable of detecting rotation of a rotation operating member as well as imparting feedback for a rotation operation to a user while avoiding a significant increase in necessary surface area for the circuit board.

The rotation operating device provided by the present invention includes a rotation operating member provided on a circuit board so as to be rotatable around an axis in a direction substantially parallel to a normal direction of the circuit board; a rotation detection switch provided on the circuit board and detecting rotation of the rotation operating member; and an operational feedback imparting mechanism for imparting operational feedback to a user by intermittently acting in conjunction with rotation of the rotation operating member. The rotation operating member includes an inner circumferential surface surrounding an interior space, and the rotation detection switch and the operational feedback imparting mechanism are both positioned within this interior space. The rotation detection switch includes a rotation sensor capable of an undulating action and a switch main body outputting a detection signal for each undulating action of the rotation sensor. The rotation operating member includes a switch operator having a shape causing the rotation sensor of the rotation detection switch to intermittently undulate in conjunction with rotation of the rotation operating member, and an operational feedback generator formed on an inner circumferential surface of the rotation operating member in a position away from the switch operator at least in a direction parallel to an axis at a center of rotation of the rotation operating member, and having a shape causing the operational feedback imparting mechanism to act in conjunction with rotation of the rotation operating member.

Further, for the operational feedback generator to be "formed on an inner circumferential surface of the rotation operating member in a position away from the switch operator at least in a direction parallel to an axis at a center of rotation of the rotation operating member" means that a position of the operational feedback generator and a position of the switch operator may be offset at least in a direction which includes a component of "a direction parallel to an axis at a center of rotation of the rotation operating member." The description does not limit whether or not they are offset in another direction, i.e., a rotation direction or a radial direction of the rotation operating member.

Both the rotation detection switch and the operational feedback imparting mechanism are positioned in the interior of the tubular rotation operating member in the rotation operating device according to the present invention. Therefore, there is largely no increase in necessary surface area for the circuit board, and detection of rotation of the rotation operating member and giving a user feedback for a rotation operation may be achieved simultaneously.

MODE FOR CARRYING OUT THE INVENTION

A first embodiment of the present invention is described with reference to FIGS. 1-5.

Figure 1:
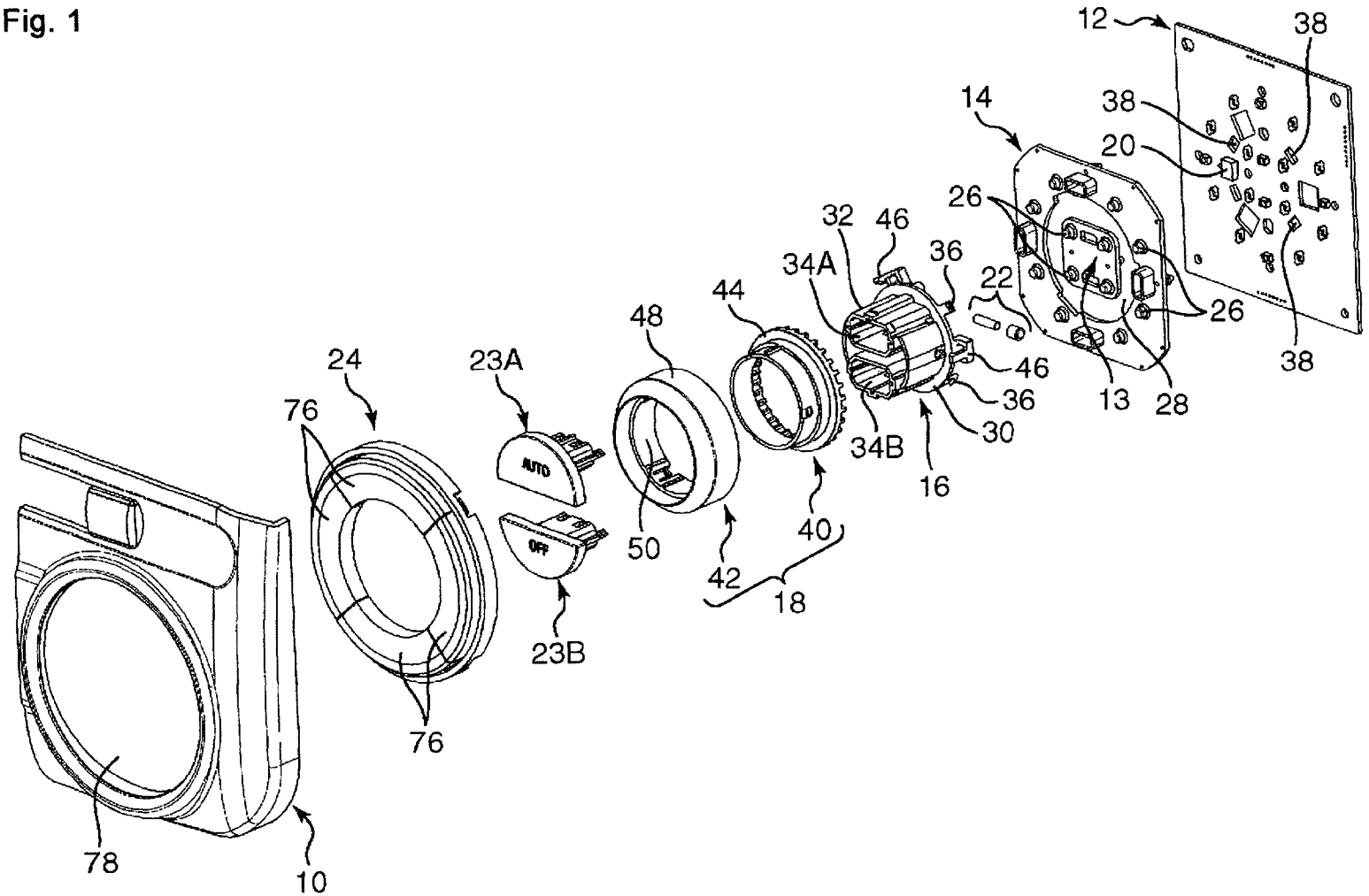
FIG. 1 is an exploded perspective view of a panel unit according to a first embodiment of the present invention.
Figure 2:
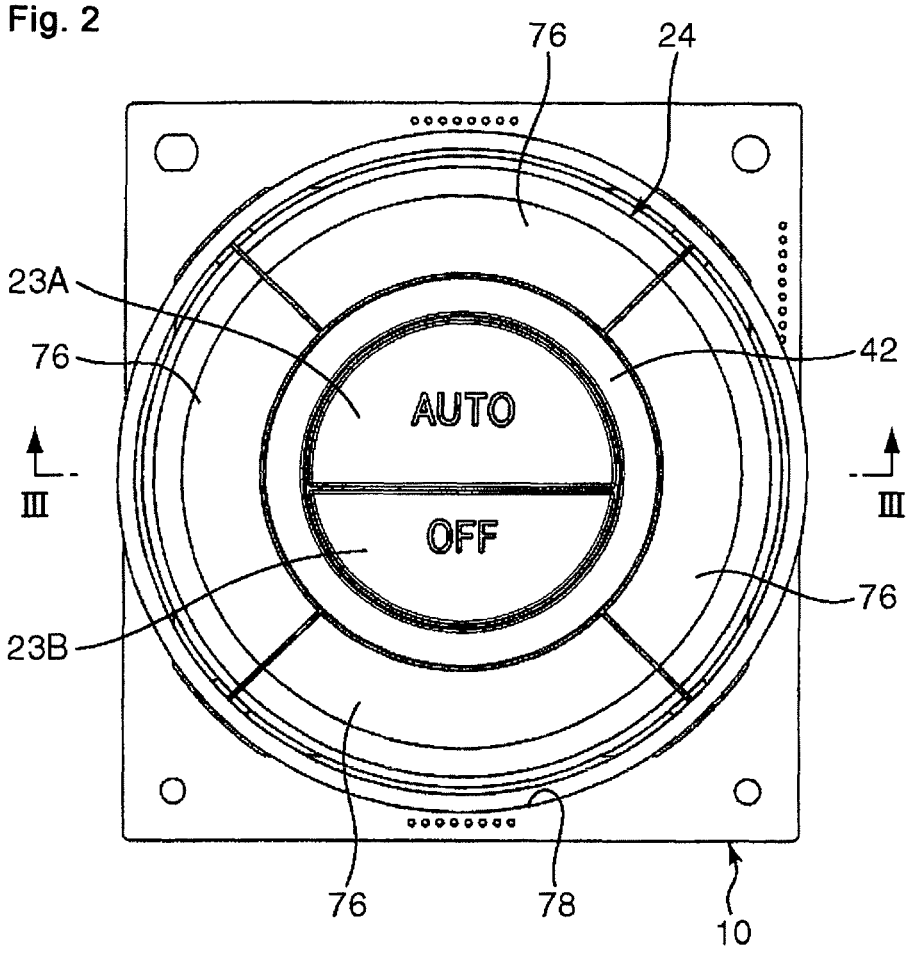
FIG. 2 is a front view of the panel unit.
Figure 3:
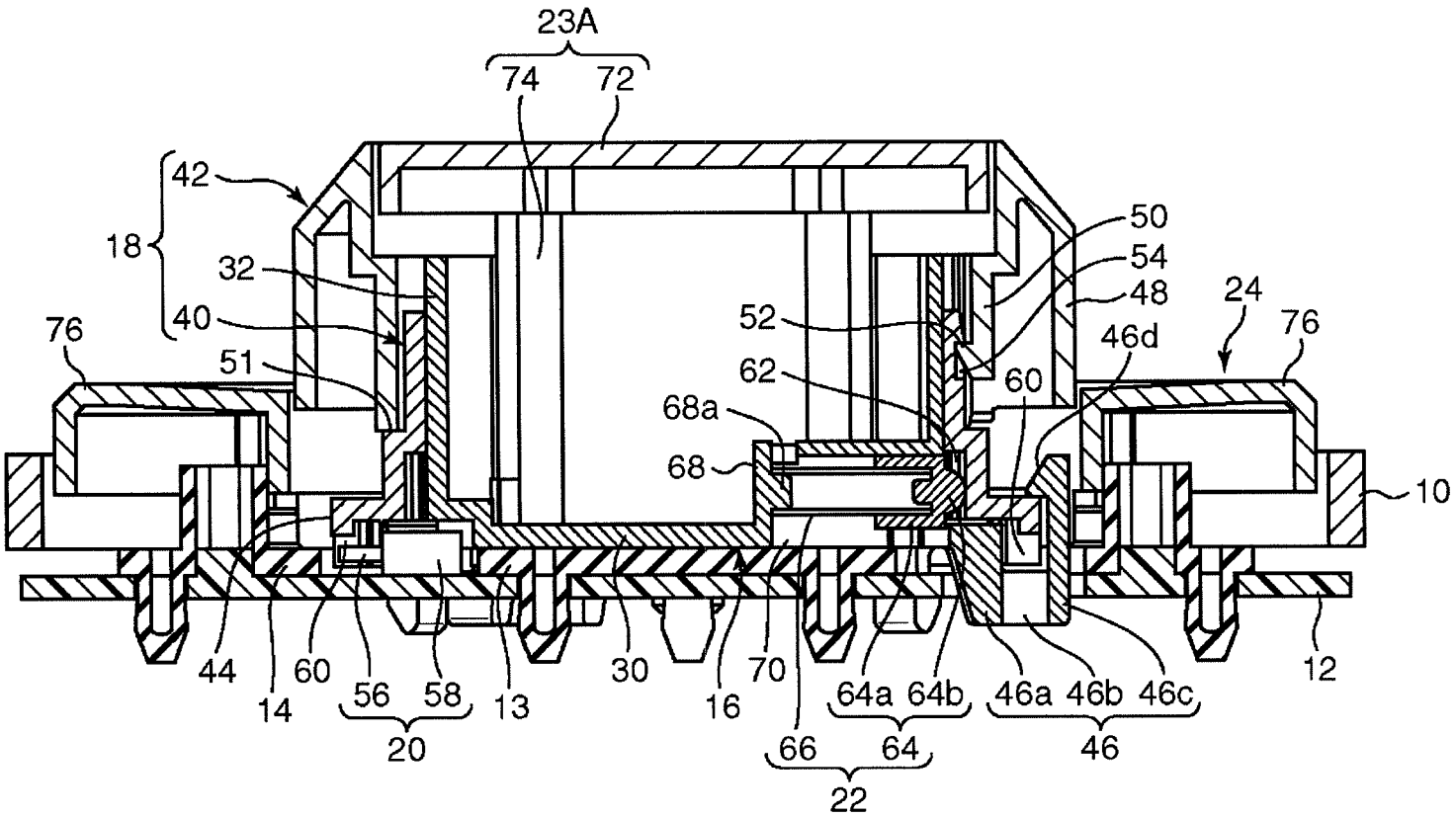
FIG. 3 is a cross-sectional view along a line III-III in FIG. 2.
Figure 4:
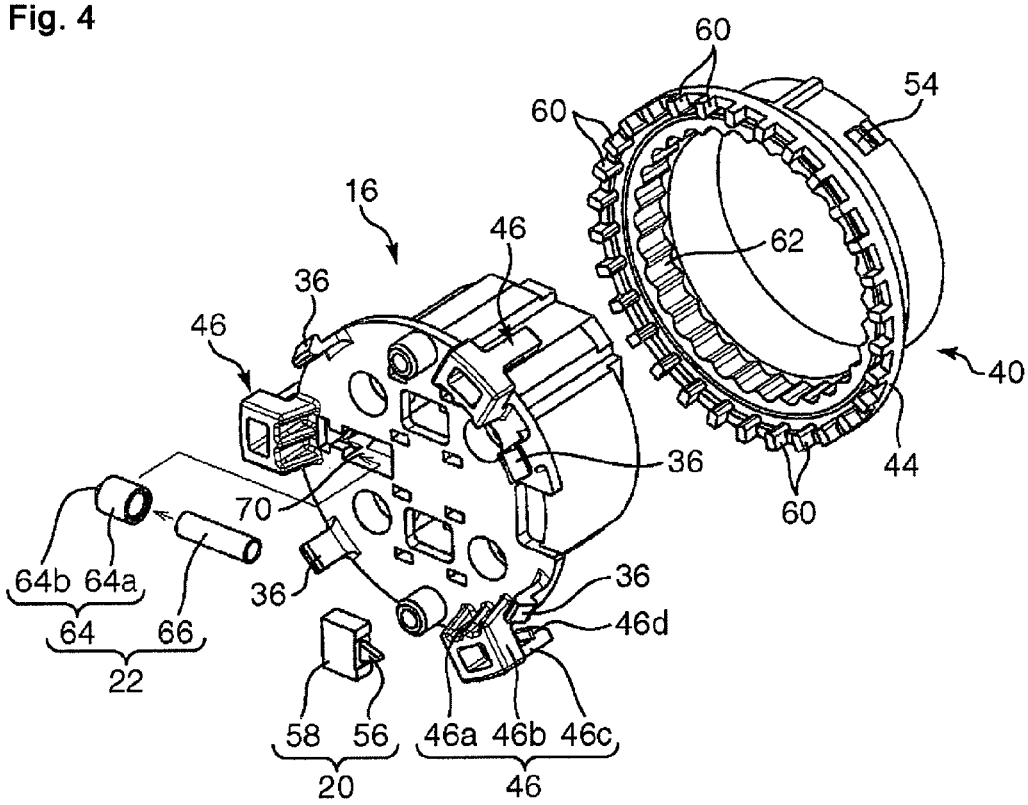
FIG. 4 is an exploded perspective view of a main portion of a rotation operating device included in the panel unit, as viewed from the rear.
Figure 5:
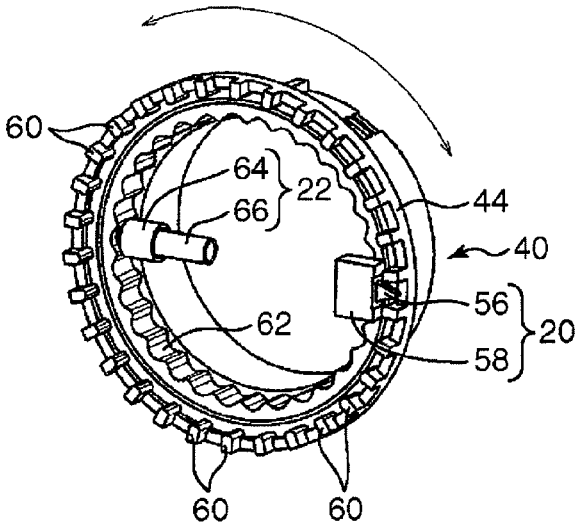
FIG. 5 is a perspective view of an assembled state of the main portion, as viewed from the rear.

FIGS. 1-3 illustrate a panel unit including a rotation operating device according to the present invention. The panel unit includes a panel 10 provided to a vehicle cabin interior of an automobile or the like; a circuit board 12 positioned on a rear side of the panel 10; and various components provided on the circuit board 12. Among these components are rubber sheets 13 and 14; a holding member 16; a rotation operating member 18; a rotation detection switch 20; an operational feedback imparting mechanism 22; a pair of push-buttons 23A and 23B which are pressure operation members; and a button ring 24.

The rubber sheets 13 and 14 are laid over an obverse surface (a top surface in FIG. 3) of the circuit board 12. The rubber sheets 13 and 14 perform functions of light-shielding and waterproofing by properly adhering to a rear portion of the panel 10 and, in addition, portions of the rubber sheets 13 and 14 configure a plurality of rubber switches 26. Specifically, the rubber sheet 14 surrounds a circular through-hole 28 at the center thereof, and each of the rubber switches 26 are formed in a plurality of locations aligned around the periphery of the through-hole 28. The rubber switches 26 are formed in positions so as to be behind the button ring 24. The rubber sheet 13 has a substantially square shape of a size allowing placement in an area inside the through-hole 28 of the rubber sheet 13 and includes corners on each of which the rubber switches 26 are formed. The rubber switches 26 are formed in positions so as to be behind each of the push-buttons 23.

Further, the rubber sheets 13 and 14 are not essential to the present invention.

In the present embodiment, of the various components, the holding member 16, the rotation operating member 18, the rotation detection switch 20, and the operational feedback imparting mechanism 22 configure the rotation operating device according to the present invention.

The holding member 16 is fixated on the circuit board 12 and, in addition, holds the rotation operating member 18 so as to be rotatable around an axis substantially parallel to a normal direction of the circuit board 12 (axis at a center of rotation). Moreover, the holding member 16 holds the operational feedback imparting mechanism 22 and, in addition, holds the pair of push-buttons 23A and 23B.

The holding member 16 includes a base wall 30 resting on the rubber sheet 13 and a circumferential wall 32 rising on an obverse side (a top side in FIG. 3) of the circuit board 12 from an outer circumferential edge of the base wall 30. The holding member 16 further includes button holders 34A and 34B slidably holding each of the push-buttons 23A and 23B on an interior of the circumferential wall 32. A plurality of latching projections 36 (FIGS. 1 and 4) project on a rear side from a bottom surface of the base wall 30, while through-holes 38 are formed on the circuit board 12 into which each of the latching projections 36 fits. The latching projections 36 have a shape capable of being latched to the circuit board 12 by being pressed into the corresponding through-hole 38.

The specific configuration in which the holding member 16 holds the rotation operating member 18 and the operational feedback imparting mechanism 22 is described in greater detail hereafter.

In the present embodiment, the rotation operating member 18 is configured with a dial holder 40 and a dial 42 held thereby. Each of these has a substantially semi-cylindrical shape and surrounds a space accommodating the push-buttons 23A and 23B in the interior thereof.

The dial holder 40 is rotatably held by the holding member 16. Specifically, a back end of the dial holder 40 (an end close to the circuit board 12) is configured with a large diameter portion 44 having a diameter larger than other portions, and this large diameter portion 44 is held by the holding member 16. The holding member 16 includes a plurality of clasping portions 46 clasping the large diameter portion 44 from an outer side in the radial direction thereof. As shown in FIG. 3, each of the clasping portions 46 integrally includes a base 46*a* passing through the circuit board 12 from the base wall 30 of the holding member 16 and projecting to a rear side thereof (a downward side in FIG. 3); a middle portion 46*b* extending outward in the radial direction of the holding member 16 from the base 46*a*; and a latch 46*c* extending to an obverse side (an upward side in FIG. 3) from an outer end in a radial direction of the middle portion 46*b*. A latching projection 46*d* projects inward from a tip of the latch 46*c*. By contacting the large diameter portion 44 on an obverse side thereof, the latching projection 46*d* prevents disengagement of the large diameter portion 44 (displacement to a direction separated from the circuit board 12) while allowing rotation of the holding member 16.

The dial 42 is held by a main body portion of the dial ring 40 (a front side portion having a diameter smaller than the large diameter portion 44) so as to rotate integrally therewith. Specifically, the dial 42 has a double structure having an outer circumferential wall 48 and an inner circumferential wall 50. Meanwhile, a stepped portion 51 capable of direct contact with a rear end of the inner circumferential wall 50 of the dial 42 is formed at a middle portion of the dial ring 40. Within the main body portion of the dial ring 40, a portion to the front of the stepped portion 51 has a diameter smaller than a portion to the rear. The inner circumferential wall 50 of the dial 42 is engaged by an outer side of this small diameter portion and, in addition, the rear end thereof projects to contact the stepped portion 51. Moreover, inwardly projecting latched projections 52 are formed in a plurality of positions on the rear end of the inner circumferential wall 50, and latching holes 54 engaging the latched projections 52 are formed on the dial holder 40.

The rotation detection switch 20 is provided on the circuit board 12 and detects rotation of the rotation operating member 18. A special feature of this device is that the rotation detection switch 20 is positioned inside a space on an interior of the dial holder 40, along with the operational feedback imparting mechanism 22, described hereafter.

The rotation detection switch 20 includes a rotation sensor 56 capable of an undulating action in both a left and right direction, and a switch main body 58 outputting a detection signal for each undulating action of the rotation sensor 56. The switch main body 58 is mounted on the circuit board 12. In the present embodiment, the rotation sensor 56 is oriented outward in a radial direction of the dial holder 40 and, in addition, the mounting orientation of the switch main body 58 is set so as to perform the undulating action on a flat surface along the circuit board 12 (that is, such that the axis at a center of rotation accompanying the undulation matches the normal direction of the circuit board 12).

Meanwhile, a switch operator having a shape causing the rotation sensor 56 of the rotation detection switch 20 to intermittently undulate in conjunction with rotation of the dial holder 40 and the dial 42 is formed on the large diameter portion 44 of the dial holder 40. The switch operator according to the present embodiment includes a plurality of operating projections 60. These operating projections 60 are arrayed at equal intervals in a circumferential direction of the large diameter portion 44 and project from the reverse face of the large diameter portion 44.

In conjunction with rotation of the dial holder 40, each of the operating projections 60 and the rotation sensor 56 intermittently come into contact, and the undulating action of the rotation sensor 56 is repeated. In other words, an action in which each of the operating projections 60 causes the rotation sensor 56 to dip and an action in which, after the operating projection 60 is separated from the rotation sensor 56, the rotation sensor 56 returns to an upright position by itself are repeated. The switch main body 58 outputs a signal corresponding to the dip direction (i.e., rotational direction) each time the undulating action is performed. The circuit board 12 and the switch main body 58 are connected so as to input this signal to the circuit board 12.

The operational feedback imparting mechanism 22 intermittently acts so as to impart operational feedback to the user in conjunction with rotation of the dial holder 40 and the dial 42. The operational feedback imparting mechanism 22 is held by the holding member 16 at a position on the obverse side (top side in FIG. 3) thereof at a slight distance from the circuit board 12, i.e., in a position offset in a direction parallel to the rotation axis direction of the dial holder 40 and the dial 42 with respect to the rotation detection switch 20.

Meanwhile, an operational feedback generator 62 is formed on the inner circumferential surface of the main body portion of the dial holder 40 (a portion away from the large diameter portion 44 in a direction parallel to the rotation axis direction of the dial holder 40). The operational feedback generator 62 is for causing the operational feedback imparting mechanism 22 to intermittently act in conjunction with rotation of the dial holder 40 and the dial 42, and is configured with a cam face in the present embodiment. This cam face has a curved surface undulating smoothly in the radial direction of the dial holder 40 and associated with progression in the circumferential direction of the dial holder 40.

In the present embodiment, the operational feedback imparting mechanism 22 is configured with a plunger 64 and a compression coil spring 66.

The plunger 64 includes a main body 64*a* and a contact portion 64*b*. The main body 64*a* has a shape open in only one direction, having a cylindrical circumferential wall and a terminal wall sealing one opening thereof. The contact portion 64*b* has a hemispherical shape and projects outward from the terminal wall. Also, the contact portion 64*b* contacts the operational feedback generator 62 from an inner side in a radial direction and, in addition, the plunger 64 is held by the holding member 16 such that the plunger 64 is movable in an axial direction thereof (that is, a radial direction of the holding member 16).

The compression coil spring 66 corresponds to a bias according to the present invention, and biases the contact portion 64*b* toward the operational feedback generator 62 (that is, outwardly) so as to maintain contact between the contact portion 64*b* and the operational feedback generator 62 (that is, the cam face). Specifically, the compression coil spring 66 is interposed in a compression-deformed state between the plunger 64 and a supporting wall 68 (FIG. 3) rising at a substantially middle position of the base wall 30. More specifically, one end of the compression coil spring 66 is inserted to an interior of the main body 64*a* of the plunger 64, and the other end is engaged on an exterior of a supporting projection 68*a* projecting outward from the supporting wall 68. In addition, an attachment through-hole 70 for enabling the plunger 64 and the compression coil spring 66 to be set in a proper position from the base wall 30 side is provided on the base wall 30 of the holding member 16.

In the present invention, the position of the rotation detection switch 20 and the position of the operational feedback imparting mechanism 22 may be offset at least in a direction parallel to the rotation axis direction of the dial holder 40 and the dial 42. Moreover, however, a feature of the present embodiment is that the rotation detection switch 20 and the operational feedback imparting mechanism 22 are positioned so as to be separated from each other by 180° in a rotation direction of the rotation operating member 18 (in the present embodiment, the dial holder 40 and the dial 42).

The push-buttons 23A and 23B each include a pressed plate 72 receiving pressure from a finger or the like, and a held portion 74 extending to a rear side from the pressed plate 72. The held portions 74 each have a shape capable of being fitted within the button holders 34A and 34B of the holding member 16 and, by being so fitted, are held so as to be slidable in a pressure operation direction of the push-buttons 23A and 23B (a direction parallel to the normal direction of the circuit board 12).

The button ring 24 has an annular shape positioned on the periphery of the dial 42. The button ring 24 includes a plurality (four in the depicted example) of buttons 76 aligned with one another in a circumferential direction, and a hinge not included in the drawings linking the buttons 76 with one another. Each button 76 is interconnected such that a pressure operation can be received independently from one another (that is, such that relative displacement in a pressure operation direction is possible).

The panel 10 includes an opening 78 allowing the button ring 24, the dial 48, and the push-buttons 23A and 23B to protrude to an obverse side.

Moreover, the rotation operating device according to the present invention is not limited to a configuration of a combination control panel unit on which pressure operations are performed, as in the present embodiment. That is, the rotation operating device according to the present invention may be provided independently, as well.

Next, an action of the rotation operating device according to the present embodiment is described.

When the dial 42 of the rotation operating member 18 is rotatingly operated in either direction while being gripped by fingers or the like, the dial holder 40 rotates integrally therewith. In conjunction with this rotation, each of the operating projections 60 of the switch operator formed on the large diameter portion 44 of the dial holder 40 contacts the rotation sensor 56 of the rotation detection switch 20 in succession. Thereby, the rotation sensor 56 is repeatedly caused to undulate in a direction corresponding to the direction of the rotation. Accordingly, the switch main body 58 of the rotation detection switch 20 outputs a type of detection signal corresponding to the dip direction of the rotation sensor 56 for each undulating action, and inputs the detection signal to the circuit board 12. The rotational direction and rotation amount of the dial 42 are obtained from the type and number of the detection signal.

Meanwhile, in conjunction with rotation of the dial holder 40, the operational feedback imparting mechanism 22 intermittently acts to impart feedback for a rotation operation to a user. Specifically, the plunger 64 of the operational feedback imparting mechanism 22 is pressed against the operational feedback generator 22 by the elastic force of the compression coil spring 66 such that the contact portion 64*b* is in constant contact with the cam face configuring the operational feedback generator 62 on the dial holder 40 side. Thus, in conjunction with rotation of the dial holder 40, which includes the operational feedback generator 22, the plunger 64 is repeatedly pressed back to an inner side in the radial direction against the elastic force of the compression coil spring 66. The tremor arising from this action of the plunger 64 is transmitted to the user through the dial 42.

In the present device, the operational feedback imparting mechanism 22 and the rotation detection switch 20 are each positioned within a space on an interior in the radial direction of the dial holder 40, which configures the rotation operating member 18. Thus, space is not required for positioning the rotation detection switch 20 and the operational feedback imparting mechanism 22 in the vicinity of the rotation operating member 18. This reduces the necessary surface area of the circuit board 12 and enables miniaturization thereof, and alternatively enables an increase in the number of components which can be mounted on the circuit board 12.

Moreover, the operating projections 60 for operating the rotation detection switch 20 and the operational feedback generator 62 for activating the operational feedback imparting mechanism 22 are provided at positions separated from each other in a direction parallel to the rotation axis direction of the rotation operating member 18. Therefore, regardless of placement, the rotation detection switch 20 and the operational feedback imparting mechanism 22 can both be activated simultaneously with no inconvenience. In particular, in the present embodiment, the switch main body 58 is mounted on the circuit board 12 such that the signal output by the switch main body 58 of the rotation detection switch 20 is input to the circuit board 12, and the operational feedback imparting mechanism 22 is provided at a position separated from the circuit board 12 farther than the rotation detection switch 20. Meanwhile, the operational feedback generator 62 is formed on the inner circumferential surface of the dial holder 40 at a position separated from the circuit board 12 farther than the switch operator. Thus, mounting of the rotation detection switch 20 directly to the circuit board 12 is enabled, while the rotation detection switch 20 and the operational feedback imparting mechanism 22 are accommodated on an interior of the rotation operating member 18 shared thereby.

Moreover, in the present embodiment, the rotation detection switch 20 and the operational feedback imparting mechanism 22 are placed at positions separated from each other by 180° in the rotation direction of the rotation operating member 18. Thus, accuracy of rotation detection with the rotation detection switch 20 can be improved using the operational feedback imparting mechanism 22. Specifically, in the present rotation operating device, there is a possibility that some amount of shifting (displacement) will develop in the rotation operating member 18 and this shifting may become a cause of reduction in detection accuracy by imparting variation in relative positioning between the rotation sensor 56 of the rotation detection switch 20 and each of the operating projections 60. However, the placement of the rotation detection switch 20 and the operational feedback imparting mechanism 22 described above enables the force of the compression coil spring 66 on the operational feedback imparting mechanism 22 pressing the plunger 64 against the operational feedback generator 62 on the dial holder 40 to eliminate wobble in the position (shifting) of the rotation operating member 18 in a pressing direction. Accordingly, wobble is also eliminated in the relative positions of each of the operating projections 60 on the dial holder 40 and the rotation sensor 56 of the rotation detector switch 20, which is positioned opposite the operational feedback imparting mechanism 22. Detection accuracy with the rotation detection switch 20 is thus improved.

Further, in the present embodiment, in addition to the holding member 16, which is fixated on the circuit board 12, rotatably holding the rotation operating member 18, the operational feedback imparting mechanism 22 is held in a position separated from the circuit board 12. Thus, the rotation operating member 18 and the operational feedback imparting mechanism 22 can both be held on the circuit board 12 side, each at an appropriate position, with a simple configuration that does not involve an increase in the number of components.

In particular, as in the present embodiment, in a device where the rear end (end portion on a side close to the circuit board 12) of the dial holder 40 configuring the rotation operating member 18 configures the large diameter portion 44; where the switch operator (operating projections 60) is formed on the large diameter portion 44; and, in addition, where the holding member 16 has clasping portions 46 holding the large diameter portion 44 by clasping from an outer side in the radial direction, through use of the large diameter portion 44, holding of the dial holder 40 with the holding member 16 using a simple structure as well as improvement of detection accuracy of the rotation detection switch 20 can be simultaneously realized. That is, by arranging the operating projections 60, which configure the switch operator, on the large diameter portion 40, the number of operating projections 60 can be increased without reducing the placement pitch of the operating projections 60 and, thereby, detection accuracy with the rotation detection switch 20 can be improved.

The projection direction of the operating projections 60 is not limited to rearward. For example, the operating projections 60 may also project from an inner circumferential surface of the dial holder 40 inward in a radial direction thereof.

Figure 6:
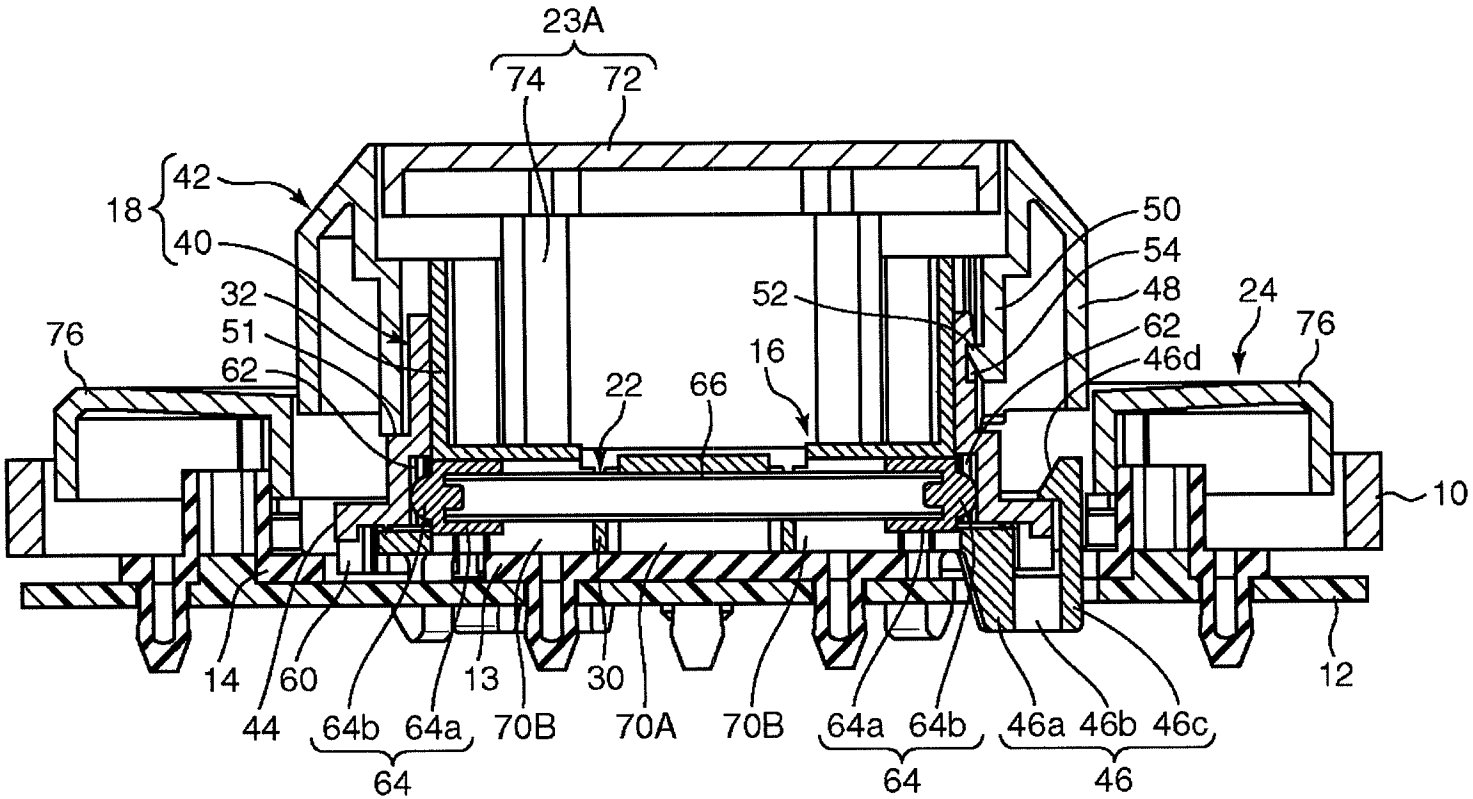
FIG. 6 is a cross-sectional view of a panel unit according to a second embodiment of the present invention, and shows a cross-section corresponding to the cross-section along the line III-III in FIG. 2.
Figure 7:
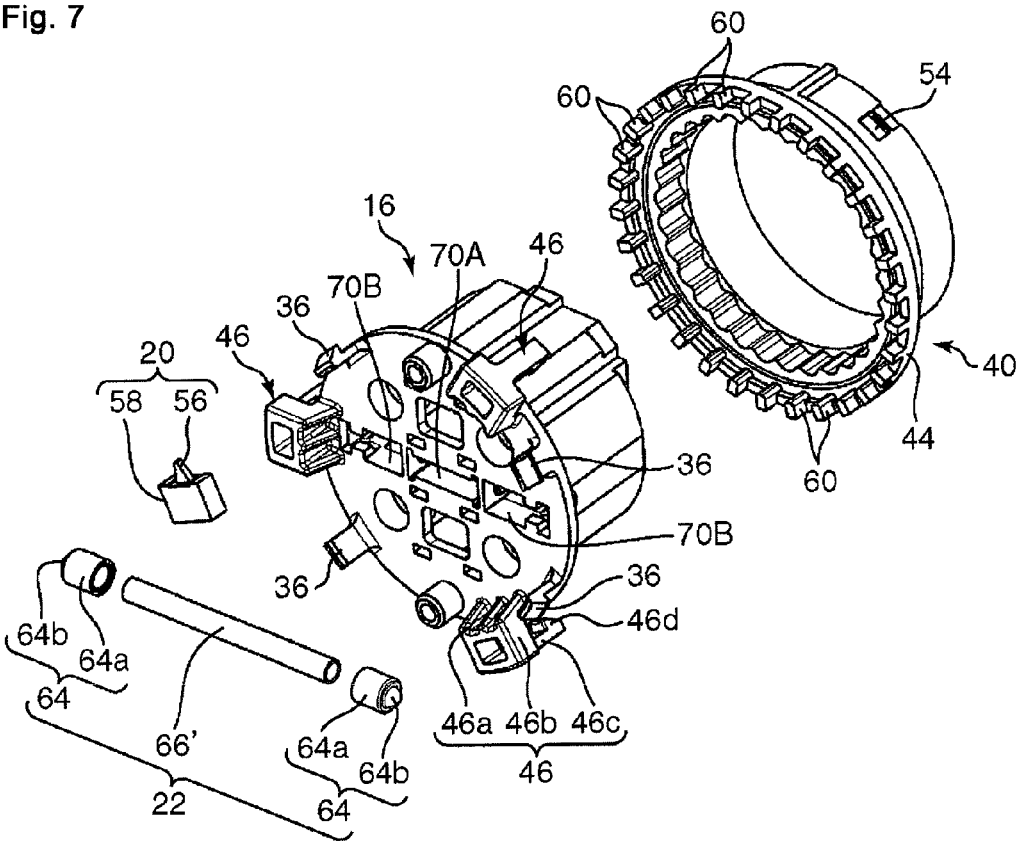
FIG. 7 is an exploded perspective view of a main portion of a rotation operating device included in the panel unit shown in FIG. 6, as viewed from the rear.
Figure 8:
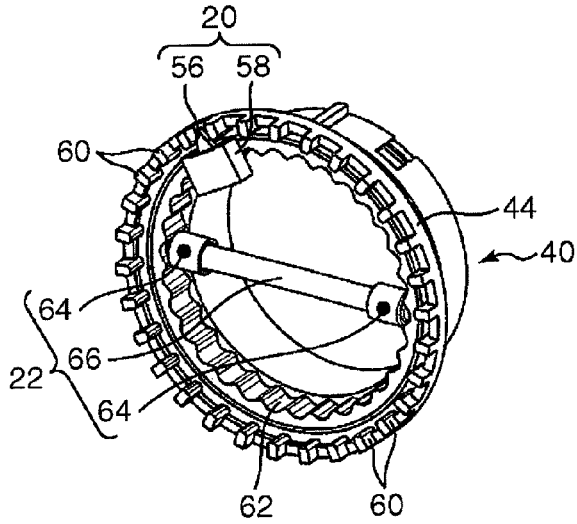
FIG. 8 is a perspective view of an assembled state of the main portion shown in FIG. 7, as viewed from the rear.
Figure 9A:
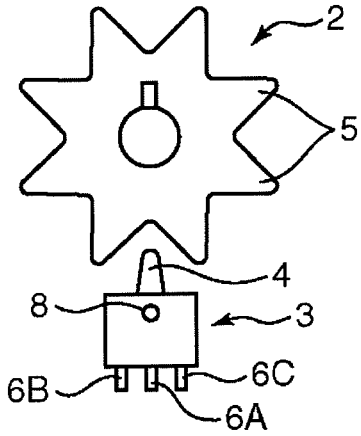
FIGS. 9(*a*) to 9(*c*) are front views illustrating an example of a conventional rotation operating device.
Figure 9B:
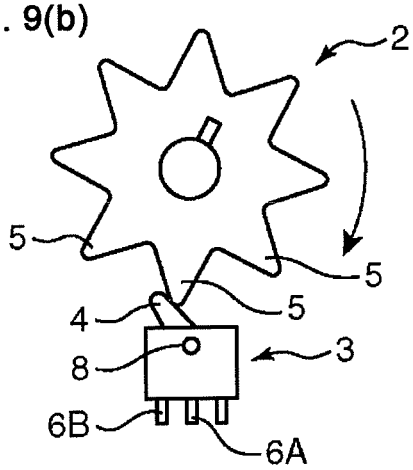
Figure 9C:
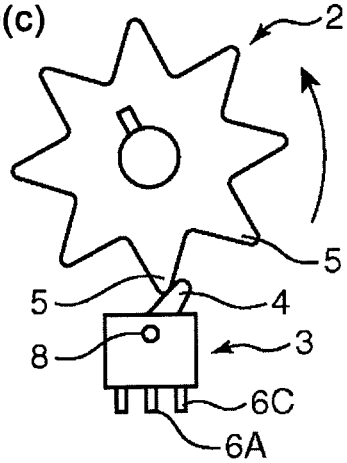

A second embodiment of the present invention is described based on FIGS. 6-8. Moreover, a basic configuration of a rotation operating device according to the present embodiment is the same as that of the first embodiment described above. Identical structural elements are given common reference numerals and their description is omitted.

In the present embodiment, the operational feedback imparting mechanism 22 is configured with a pair of plungers 64 and a compression coil spring 66'. Each of the plungers 64 is placed at a first position and a second position (left and right positions in the drawings), respectively, separated from each other by 180° in a rotation direction of the rotation operating member 18, and the compression coil spring 66' configuring the bias is placed so as to be interposed between both of the plungers 64 in an elastic compression-deformed state. The compression coil spring 66' is also held by the holding member 16, similar to the first embodiment. In addition, as shown in FIG. 7, a through-hole 70A for setting the compression coil spring 66' and a pair of through-holes 70B for setting each of the plungers 64 are provided on the base wall 30 of the holding member 16.

Meanwhile, the rotation detection switch 20 is placed in an appropriate position away from the placement positions of both plungers 64 in a circumferential direction. In the present embodiment as well, the rotation detection switch 20 is mounted on the circuit board 12, and both plungers 64 and the compression coil spring 66', which configure the operational feedback imparting mechanism 22, are held by the holding member 16 in positions separated from the circuit board 12 toward an obverse side.

In the present embodiment, the shared compression coil spring 66 can impart to the contact portions 64*b* of the plungers 64 on both outer sides thereof biasing forces which are both opposite and equal to each other, and can press both of the contact portions 64*b* against the operational feedback generator 62 with equal force. Accordingly, positional wobble of the rotation operating member in the biasing direction can be effectively inhibited. Also, the pressing load is dispersed to both of the contact portions 64*b*, and thus wear on the contact portions 64*b* (wear due to sliding contact with the operational feedback generator) can be controlled and the life of both of the contact portions 64*b* can be proportionately extended.

As described above, the present invention is a rotation operating device provided on a circuit board, and provides a device capable of detecting rotation of a rotation operating member as well as imparting feedback for the rotation operation to a user while avoiding a significant increase in necessary surface area of the circuit board. The rotation operating device is provided on the circuit board and includes the rotation operating member provided on the circuit board so as to be rotatable around an axis in a direction substantially parallel to a normal direction of the circuit board; a rotation detection switch provided on the circuit board and detecting rotation of the rotation operating member; and an operational feedback imparting mechanism for imparting operational feedback to the user by intermittently activating in conjunction with rotation of the rotation operating member. The rotation operating member includes an inner circumferential surface surrounding an interior space, and both the rotation detection switch and the operational feedback imparting mechanism are positioned within this interior space. The rotation detection switch includes a rotation sensor capable of an undulating action and a switch main body outputting a detection signal for each undulating action of the rotation sensor. The rotation operating member includes a switch operator having a shape causing the rotation sensor of the rotation detection switch to intermittently undulate in conjunction with rotation of the rotation operating member, and an operational feedback generator formed on an inner circumferential surface of the rotation operating member at a position away from the switch operator at least in a direction parallel to an axis at a center of rotation of the rotation operating member, and having a shape causing the operational feedback imparting mechanism to act in conjunction with rotation of the rotation operating member.

For the operational feedback generator to be "formed on an inner circumferential surface of the rotation operating member at a position away from the switch operator at least in a direction parallel to an axis at a center of rotation of the rotation operating member" means that the position of the operational feedback generator and the position of the switch operator may be offset at least in a direction which includes a component of "a direction parallel to an axis at a center of rotation of the rotation operating member." The description does not limit whether or not they are offset in another direction, i.e., a rotation direction or a radial direction of the rotation operating member.

In the rotation operating device, the switch operator causes the rotation sensor of the rotation detection switch to undulate in conjunction with rotation of the rotation operating member. Thereby, a repeating signal can be output from a switch main body of the rotation detection switch, and accordingly rotation of the rotation operating member can be detected. In addition, the operational feedback generator of the rotation operating member activates the operational feedback imparting mechanism, and can thereby impart operational feedback to the user. Moreover, the rotation operating member has a tubular shape surrounding an interior space and both the rotation detection switch and the operational feedback imparting mechanism are positioned within this interior space. Thus, space is not required for positioning the rotation detection switch and the operational feedback imparting mechanism outside of the rotation operating member and a corresponding reduction in the necessary surface area of the circuit board or an increase in the number of components mounted on the circuit board becomes possible. Further, in addition to the switch operator for operating the rotation detection switch being provided on the rotation operating member, the operational feedback generator for activating the operational feedback imparting mechanism is provided on the inner circumferential surface of the rotation operating member at a position away from the switch operator in a direction parallel to the axis at the center of rotation of the rotation operating member. Thus, regardless of placement, the rotation detection switch and the operational feedback imparting mechanism can both be activated simultaneously with no inconvenience.

As a specific configuration of the operational feedback imparting mechanism, the mechanism preferably includes a contact portion capable of relative displacement with the operational feedback generator in the rotation direction while in contact with the operational feedback generator, and a bias biasing the contact portion toward the operational feedback generator such that contact between the contact portion and the operational feedback generator is maintained, while the operational feedback generator preferably has a shape pushing the contact portion back toward an interior of the rotation detection member against the biasing force of the bias in conjunction with rotation of the rotation detection member.

Also, in such a case, the rotation detection switch and the operational feedback imparting mechanism are positioned so as to be separated from each other 180° in the rotation direction of the rotation operating member. Thereby, using the biasing force of the bias in the operational feedback imparting mechanism, detection accuracy of the rotation detection switch can be improved. Specifically, with this placement, positional wobble (shifting) of the rotation operating member in a pressing direction is eliminated through the force of the bias of the operational feedback imparting mechanism pressing the contact portion against the operational feedback generator of the rotation operating member. Accordingly, wobble is also eliminated in the relative positions of the switch operator of the rotation operating member and the rotation sensor on the rotation detection switch, which is at a position separated 180° in the rotation direction of the rotation operating member from the operational feedback imparting mechanism. Accordingly, variation in detection accuracy with the rotation detection switch is reduced.

Alternatively, positioning the contact portions of the operational feedback imparting mechanism at positions separated from each other 180° in the rotation direction of the rotation operating member and configuring the bias with a spring interposed in an elastic compression-deformed state between both of the contact portions is also effective. In the operational feedback imparting mechanism, the shared spring imparts to the contact portions on both outer sides thereof biasing forces which are both opposite and equal to each other, and presses both of the contact portions against the operational feedback generator with equal force. Therefore, positional wobble of the rotation operating member in those directions can be effectively inhibited. Further, the pressing load is dispersed to both of the contact portions, and thus wear on the contact portions (wear due to sliding contact with the operational feedback generator) is inhibited and the life of both of the contact portions is proportionately prolonged.

Preferably, in the rotation operating device according to the present invention, the switch main body is mounted on the circuit board such that the signal output by the switch main body of the rotation detection switch is input to the circuit board, and the operational feedback imparting mechanism is placed at a position separated from the circuit board farther than the rotation detection switch, while the operational feedback generator of the rotation operating member is placed at a position separated from the circuit board farther than the switch operator of the rotation operating member. This placement enables the rotation detection switch to be directly mounted on the circuit board while enabling the rotation detection switch and the operational feedback imparting mechanism to be accommodated on an interior of the shared rotation operating member.

In such a case, the rotation operating device preferably includes a holding member fixated to the circuit board and holding the rotation operating member rotatably, as well as holding the operational feedback imparting mechanism in a position separated from the circuit board. The holding member enables both the rotation operating member and the operational feedback imparting mechanism to be held on the circuit board side at respectively appropriate positions with a simple structure.

More specifically, a device is preferred in which an end portion of the rotation operating member on a side close to the circuit board configures a large diameter portion having an outer diameter and an inner diameter larger than other portions; the switch operator is formed on the inner circumferential surface of this large diameter portion; and, in addition, the holding member includes clasping portions holding the large diameter portion by clasping from an outer side in a radial direction thereof. By increasing the inner diameter of the switch operator formed on the inner circumferential surface thereof, the large diameter portion increases the amount of relative displacement between the rotation detection switch and the switch operator accompanying rotation of the rotation operating member for a unit angle, enabling an increase in detection accuracy with the rotation detection switch. The large diameter portion simultaneously enables the holding member to rotatably hold the rotation operating member with a simple structure, using the outer shape of the large diameter portion.

The invention claimed is:

1. A rotation operating device provided on a circuit board, comprising:

a rotation operating member provided on the circuit board so as to be rotatable around an axis in a direction substantially parallel to a normal direction of the circuit board;

a rotation detection switch provided on the circuit board and detecting rotation of the rotation operating member; and an operational feedback imparting mechanism for imparting operational feedback to a user by intermittently activating in conjunction with rotation of the rotation operating member, wherein the rotation operating member includes an inner circumferential surface surrounding an interior space, and both the rotation detection switch and the operational feedback imparting mechanism are positioned within the interior space;

the rotation detection switch includes a rotation sensor capable of an undulating action and a switch main body outputting a detection signal for each undulating action of the rotation sensor; and the rotation operating member comprises:

a switch operator having a shape causing the rotation sensor of the rotation detection switch to intermittently undulate in conjunction with rotation of the rotation operating member; and an operational feedback generator formed on an inner circumferential surface of the rotation operating member at a position spaced from the switch operator at least in a direction parallel to an axis of rotation of the rotation operating member, and having a shape causing the operational feedback imparting mechanism to act in conjunction with rotation of the rotation operating member.

2. The rotation operating device according to claim 1, wherein the operational feedback imparting mechanism comprises:

a contact portion capable of relative displacement by the operational feedback generator while in contact with the operational feedback generator; and a bias biasing the contact portion toward the operational feedback generator such that contact between the contact portion and the operational feedback generator is maintained, wherein the operational feedback generator has a shape pushing the contact portion back toward an interior of the rotation operating member against the biasing force of the bias in conjunction with rotation of the rotation operating member.

3. The rotation operating device according to claim 2, wherein the rotation detection switch and the operational feedback imparting mechanism are separated from each other by 180° in the rotation direction of the rotation operating member.

4. The rotation operating device according to claim 2, wherein the operational feedback imparting mechanism includes two of the contact portions separated from each other by 180° in the rotation direction of the rotation operating member, and wherein the bias comprises a spring interposed in an elastic compression-deformed state between both of the contact portions.

5. The rotation operating device according to claim 1, wherein:

the switch main body is mounted on the circuit board such that the signal output by the switch main body of the rotation detection switch is input to the circuit board;

the operational feedback imparting mechanism is spaced from the circuit board farther than the rotation detection switch; and the operational feedback generator of the rotation operating member is spaced from the circuit board farther than the switch operator of the rotation operating member.

6. The rotation operating device according to claim 5, further comprising a holding member fixated to the circuit board and holding the rotation operating member rotatably, as well as holding the operational feedback imparting mechanism in a position spaced from the circuit board.

7. The rotation operating device according to claim 6, wherein:

an end portion of the rotation operating member on a side close to the circuit board includes a large diameter portion having an outer diameter and an inner diameter larger than other portions thereof;

the switch operator is formed on an end surface of the large diameter portion; and the holding member includes clasping portions holding the large diameter portion by clasping from an outer side in a radial direction thereof.

* * * * *